United States Patent [19]

Leu

[11] 4,376,516

[45] Mar. 15, 1983

[54] SPOOLING MACHINE, METHOD AND APPARATUS TO PREVENT FORMATION OF CUT REMNANT THREAD PIECES

[75] Inventor: Erwin Leu, Horgen, Switzerland

[73] Assignee: Mashinenfabrik Schweiter AG, Horgen, Switzerland

[21] Appl. No.: 125,136

[22] Filed: Feb. 27, 1980

[30] Foreign Application Priority Data

Mar. 8, 1979 [CH] Switzerland ..... 2242/79

[51] Int. Cl.[3] ..... B65H 63/02; B65H 63/06

[52] U.S. Cl. ..... 242/36; 28/227

[58] Field of Search ..... 242/36; 83/13, 371; 28/225, 226, 227, 228, 242

[56] References Cited

U.S. PATENT DOCUMENTS

| | | | |
|---|---|---|---|
| 945,447 | 1/1910 | Cook | 28/228 |
| 2,036,806 | 4/1936 | Hill et al. | 28/228 X |
| 2,137,613 | 11/1938 | Hill et al. | 28/225 |
| 3,132,407 | 5/1964 | Glastra | 28/227 |
| 3,268,972 | 8/1966 | Flori | 28/242 |
| 3,511,448 | 5/1970 | Brouwer et al. | 242/36 |
| 4,292,868 | 10/1981 | Werffeli | 83/13 |

FOREIGN PATENT DOCUMENTS

| | | | |
|---|---|---|---|
| 1560453 | 8/1971 | Fed. Rep. of Germany | 242/36 |
| 979832 | 1/1965 | United Kingdom | 28/225 |

*Primary Examiner*—Robert Mackey

*Attorney, Agent, or Firm*—Frishauf, Holtz, Goodman & Woodward

[57] ABSTRACT

To prevent the formation of remnant thread pieces due to response of a thread cutting apparatus 2, 3, 4 coupled to a thread or yarn cleaning device 36, which erroneously responds with an "off-size" signal upon a thread break, the cutter blade is guided in front of the thread when tensioned—under ordinary conditions—but loose if the thread should be broken. Under tension, movement of the cutter blade 2, 3 will sever the thread; when the thread is slack, the cutter blade can move into a groove 4, 4' of a counter element or anvil, which groove is deeper than the travel of the cutter blade to accomodate the slack thread. For heavier threads, the forward portion of the cutter element can be movable (FIGS. 4–6) to be pulled against a counter surface 14 by a taut thread, but to engage into the deeper groove 4' by a slack thread not having the pulling action on the blade.

9 Claims, 6 Drawing Figures

SPOOLING MACHINE, METHOD AND APPARATUS TO PREVENT FORMATION OF CUT REMNANT THREAD PIECES

CROSS REFERENCE TO RELATED APPLICATION

U.S. Ser. No. 125,137, now U.S. Pat. No. 4,292,868, WERFFELI, assigned to the assignee of this application.

The present invention relates to a spooling machine, and more particularly to a spooling machine for textile yarn or thread having a large number of spindles.

BACKGROUND AND PRIOR ART

Spooling machines in which thread or yarn is spooled from a pirn or payout spool to a yarn package or takeup spool, for example to form a crosswound "pineapple" package, usually are equipped with thread cleaning apparatus which, essentially, respond to off-size condition of the thread or yarn being spooled. If such off-size condition is detected, for example undersized or oversized, a signal is provided which operates a cutting device to cut the thread so that the defective portion will not be spooled from the supply spool to the takeup package. Such thread or yarn cleaning devices respond to positions of the thread beyond a certain gauging position. If the thread or yarn should break, it will simulate in the yarn cleaning apparatus an off-size condition, causing the cutting apparatus to operate. It has been found from experience that under most conditions, thread breaks occur in the region between the yarn cleaning apparatus and the takeup package winding apparatus so that the yarn cleaning device will respond and provide a cut-off signal to the cutter. The cutter is usually located between the payout pirn or spool and the yarn cleaning device, so that a remnant cut piece of thread will be in the machine and having the length from the broken end to the cut end. This is a region in the machine where cut thread pieces are knotted to the previously spooled thread pieces. It may happen that this excess remnant is worked into the re-knotted thread, which leads to substantial reduction in overall quality, that is, reduction of uniformity of the thread being wound on the takeup package.

Removal of such excess remnant threads is important, and in order to remove these thread pieces, it has been proposed to locate suction nozzles close to the thread and usually positioned just above the thread cleaning apparatus which senses the dimensional relationship of the thread. Suction air continuously acts on the thread as it runs through the thread cleaning apparatus, so that the thread is additionally loaded. The suction nozzles require continued supply of energy for suction air, and their size interferes with accessibility of the thread cleaning apparatus and of the thread itself. In spite of complex and extensive apparatus elements, it has not been possible to reliably remove such excess remnant thread pieces.

THE INVENTION

It is an object to improve spooling machines by eliminating the occurrence of excess thread ends in case of a thread break.

Briefly, thread tension is sensed and, if thread tension should fail—for example due to a thread break—the thread cutting apparatus is prevented from cutting the thread; thus, the thread cutting apparatus will respond by cutting action only if (a) the thread is properly tensioned, and additionally, (b) the thread is off-size. In case of condition (a), that is, failure of thread tension, and while nevertheless the thread cleaning apparatus furnishes an off-size signal, e.g. due to location of the thread outside the ganging position, the thread cutting operation is inhibited since the conjunctive relationship between thread tension (condition a) and off-size signal (condition b) is not satisfied.

In accordance with a feature of the invention, the thread is passed in front of a knife blade which operates against a counter anvil. The counter anvil is spaced from the maximum distance of throw of the knife blade by at least the distance of the thickness of the thread so that, if the thread is slack, the knife blade will merely press or squeeze the thread against the anvil without, however, cutting it; if the thread is taut, however, that is, is under tension (condition (a) above), a cutter command signal will reliably sever the thread upon engagement of the thread with the knife blade.

The arrangement has the advantage that, with few structural elements and only minor modification of existing cutting apparatus, it is possible to entirely avoid the formation of excess remnant thread pieces upon a thread break, without requiring any continued operating costs for suction air and the like; thus, while simultaneously reducing operating costs, the quality of production output is substantially enhanced.

In accordance with a preferred feature of the invention, the construction of the thread cutter can be so arranged that the cutter operates against an inclined surface which forms the counter surface or anvil therefor, the anvil surface, for example, forming not only a counter cutting surface but also a guide surface for the cutter blade itself. The cutter blade is pivotable in a direction transverse to the running direction of the thread. If the thread is under tension and a "cut" signal is derived from the thread cleaning apparatus, the tensioned thread will tend to guide the cutter blade against the anvil or counter surface, thus reliably effecting cut of the thread. If the thread should be loose, however, for example due to a break beyond the cleaning apparatus, and the cleaning apparatus still provides an "off-size" signal, which causes a "cut" signal, the lack of tension will permit the cutter blade to move as commanded without, however, gripping or engaging the thread and pushing it against the counter surface, since the now untensioned or loose thread did not move the cutter blade against the anvil surface. The pivoting action of the cutter blade can be obtained by a separate pivot or by forming the cutter blade in the shape of a leaf spring which can deflect when engaged on the edge by the thread when under tension.

DRAWINGS

Figure 1:
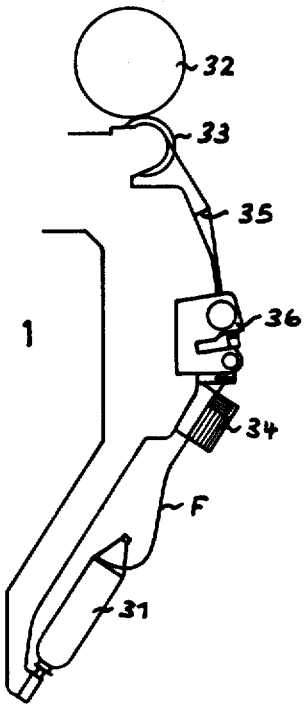
FIG. 1 is a highly schematic illustration of the spooling path of yarn or thread from a payout spool or pirn to a takeup package of a multiple spindle spooling machine, showing only one spooling path or spindle arrangement.

An automatic cross winding yarn package spooling machine, of which one spindle position is shown in FIG. 1, provides for spooling of a thread F from a supply spool or pirn 31 onto a crosswound yarn package 32. The yarn is supplied and fed to package 32 from a wind-up drum 33 which provides for yarn traverse and drive of the package 32. An anti-ballooning unit 34 guides the thread or yarn F from payout spool 31 to a yarn cleaning apparatus 36 from which the yarn passes along a guide strip 35 to the windup system 33,32.

The yarn cleaning apparatus 36 senses the size of the yarn with respect to predetermined off-size limits; if the yarn is too thick or too thin, the yarn is to be separated or severed so that the respective off-size defective thread or yarn portions can be removed from yarn wound up on package 32. Apparatus 36, as such, is well known; it provides an electrical output signal based on optical or capacitative sensing of the yarn or thread dimensions. Variations in dimensions which exceed certain threshold limits then will result in an off-size signal. A break of the yarn in the region between the yarn cleaning device 36 and the takeup package 32, resulting in loss of tension, will cause the yarn cleaning device 36 to respond since it will have simulated therein an off-size signal, due to change in capacity or change in optical path of the yarn beyond that which is commanded under ordinary spooling conditions. Thus, a break in the yarn will result in a "cut" or "sever" signal if the yarn F, upon an ordinary yarn break, causes an "off-size" signal to occur within the measuring or sensing cell arrangement of the yarn cleaning apparatus 36.

Figure 2:
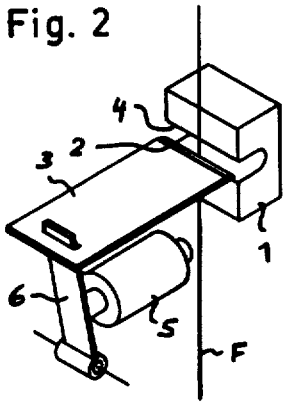
FIG. 2 is a perspective view of a cutter arrangement operating under control of an electric yarn cleaning device, and constructed in accordance with the present invention, in rest position with a tensioned thread.

A "cut" signal is applied to an electromagnet (FIG. 2) which is integrated with the yarn cleaning or sensing apparatus 36. The yarn severing or cutting apparatus further includes a flip armature 6 which cooperates with the solenoid coil 5 of the electromagnet. The armature 6 is coupled to a cutting blade 3 which has a sharp cutter edge 2. Upon energization of the solenoid 5, the blade 3 moves to the right (FIG. 2). The blade 3 cooperates with a counter element or anvil 4.

Under normal operating conditions, the thread F passes in front of the cutter blade 3 as shown in FIG. 2, that is, under tension, and with slight clearance from the cutting edge 2. To prevent cutting of the thread F if the cleaning apparatus should have responded and thread tension was lost due to a thread break beyond the cleaning apparatus, the anvil 1 is formed with a groove 4 to permit the blade 3 to engage therein. The width of the groove 4 is just slightly greater than the thickness of the blade 3; the depth of the groove 4 is slightly longer than the penetration depth of the blade 3. Preferably, the arrangement is so made that the width of the groove 4 is at least as wide as the thickness of the blade 3 plus twice the thickness of the thread being spooled. The depth of the groove 4 should be at least as deep as the penetration depth of the blade 3 plus the thickness of the thread F.

Operation: Under normal conditions, the thread F is guided in front of the edge 2 as shown in FIG. 2. If an "off-size" signal is derived from the cleaning sensor 36, solenoid 5 is energized and blade 3 with the cutter 2 will move smartly to the right. The cutter blade 2 will sever the thread F which is tensioned in front of the blade 2.

If the thread should break between the cleaning or sensing unit 36 and the takeup spool 32, the thread will lose tension. An "off-size" signal may be derived from the cleaning apparatus 36 since the loose thread end may simulate an "off-size" condition. Upon movement of the blade 3 to the right, the thread—now slack—will merely be pushed into the groove 4 and held therein, without severing the thread F, however—see FIG. 3 by the cutting edge 2. Thus, formation of an excess loose piece, or remnant of thread upwardly (FIG. 2 or 3) of the cutter blade 3 is prevented.

Figure 5:
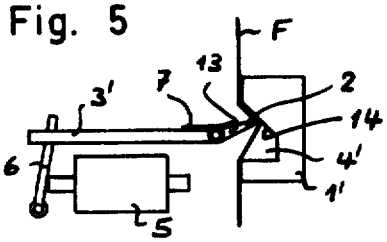
FIGS. 5 and 6 are views similar to FIG. 4, showing operation of the cutter apparatus with a tensioned thread upon receipt of an off-size signal (FIG. 5) and upon thread break (FIG. 6), respectively.
Figure 6:
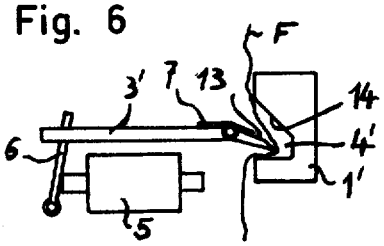
Figure 4:
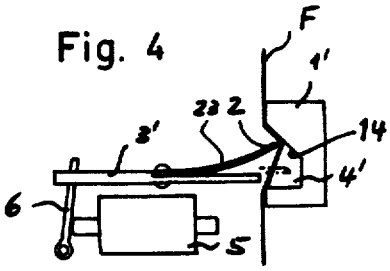
FIG. 4 is a highly schematic side view of another embodiment of the apparatus using a flexible cutter blade operating against an inclined anvil.

The apparatus works well with many types of threads; to sever heavy or thicker yarns or threads, the arrangement of FIGS. 4–6 is preferred.

Figure 3:
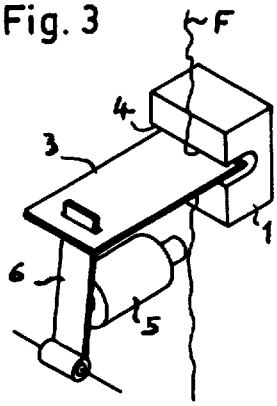
FIG. 3 illustrates the operated position of the structure of FIG. 2, after a thread break.

The spooling arrangement is identical to FIG. 1; rather than forming a groove 4 in the counter element or anvil 1, as shown in FIGS. 2 and 3, a wider recess or groove 4' is formed in the counter element 1' and shaped to have an inclined surface 14 which opens towards the thread F. The counter element or anvil 1' with the surface 14 cooperates with the cutting edge 2 of the cutter element in this way: The cutting edge 2 is located on a movable forward portion 13 of the cutter blade 3'. This movable forward portion may have various forms: For example—see FIG. 4—the forward portion is a leaf spring 23, which is spring-elastic; in accordance with FIGS. 5 and 6, the forward portion 13 is pivoted to the blade 3', and biassed downwardly by a spring 7 if the weight of the forward portion 13 is insufficient to leave the forward portion 13 in downward position unless pulled upwardly.

Operation: If the yarn cleaning sensing device 36 provides an "off-size" signal while the yarn F is tensioned, then the blade 3' is moved towards the right (FIGS. 4, 5, 6). The tensioned thread F, upon engagement with the blade and due to its running speed—being pulled upwardly by the rotating takeup package 32—will pull the movable forward portion 13 (FIG. 5) or 23 (FIG. 6) upwardly, thus moving the cutting edge 2 against the surface 14 of the counter element or anvil 4'. The cutting edge will now reliably cut the thread or yarn F betwen the edge 2 and the engagement counter surface 14 of the anvil 4' (see FIGS. 4, 5).

If the thread or yarn should have broken, and an "off-size" signal is also derived due to the unguided position of the broken yarn in sensor 36, the thread F will not be under tension and thus the thread cannot pull the movable forward engagement portion 13, 23 from its dropped position as shown in FIG. 6, or in broken lines in FIG. 4. The cutting edge 2 thus will not engage the inclined counter surface 14 but can move freely within the depth of the groove 4' which, as in the embodiment of FIGS. 2 and 3, is deeper than the length of the travel of the cutter 3'. Thus, the thread or yarn F will not be severed but will be held in the position shown in FIG. 6. Thus, cutting is reliably effected against a counter surface when the thread is tensioned, but no cutting will result if the thread is loose or untensioned, for example due to a break between the yarn cleaning device 36 and the takeup package 32.

Various changes and modifications may be made, and features described in connection with any one of the embodiments may be used with any of the others, within the scope of the inventive concept.

I claim:

1. In a spooling machine in which yarn or thread (F) is spooled from a payout spool (31) to a takeup package (32) having means (36) sensing thread size and providing an "off-size" signal if the thread size exceeds predetermined threshold limits and if the thread is positioned outside of predetermined limits responsive to loss of tension simulating an "off-size" signal within the sensing means, and thread cutting apparatus (1-6) including a cutter knife (2, 3) having a cutter blade and a counter anvil (1) towards which the knife moves during cutting, said cutter apparatus being positioned in the path of the thread from the payout spool to the takeup package and the cutter knife being operative to move in a direction to sever the thread when the "off-size" signal is sensed, and comprising, in accordance with the invention, means to prevent cutting of the thread upon failure of thread tension comprising a groove (4,4') formed in the anvil (1) and positioned to permit the cutter knife to penetrate therein, said groove having a depth which is deeper than the end position of the cutter blade upon movement of the cutter blade when responding to an "off-size" signal and having a width which is wider than the thickness of the cutter blade to permit movement of the cutter blade into the groove, with slack thread, without severing the thread.

2. Apparatus according to claim 1, wherein the size of the groove is at least as deep as the moving distance of the cutter blade plus the thickness of the thread, and the width of the groove is at least as wide as the thickness of the cutter blade (3) plus twice the thickness of the thread (F).

3. Apparatus according to claim 1, wherein the groove (4') is deeper than the distance of movement of the cutter blade when responding to an "off-size" signal plus at least the thickness of the thread;

the groove (4') is formed with a forwardly inclined surface, extending at an inclination in the direction of spooling movement upon spooling of the thread (F) from the payout spool to the takeup package in said path;

and the cutter blade is movable toward said inclined surface when an "off-size" signal is sensed, the thread, when being tensioned, lifting the cutter blade due to frictional engagement of the moving thread against the cutting edge (2) of the cutter blade and towards the inclined counter surface (14) of the anvil (1') whereas, upon a thread break causing slack thread to appear before the cutter blade, the moveable forward portion of the blade can engage within the groove (4') without cutting engagement with the thread (F).

4. Apparatus according to claim 3, wherein a portion (13, 23) of the cutter blade facing the thread (F) is movable in the direction of movement of the thread (F) from the payout spool to the takeup package.

5. Apparatus according to claim 4, wherein the movable portion is spring-biassed counter the direction of movement of the thread.

6. Apparatus according to claim 4, wherein the movable portion comprises a spring element resiliently biassed counter the direction of movement of the thread.

7. In a spooling machine, a method to prevent formation of a cut remnant filament which may wind on package of thread being spooled with controlled tension from a payout spool (31) to a takeup package (32), which includes means (36) sensing thread-size and providing an "off-size" signal if the size exceeds predetermined threshold limits, and if the thread is positioned outside of predetermined limits responsive to loss of tension simulating an "off-size" signal within the sensing means, and having thread cutting apparatus (2-6) including a cut-off knife (2, 3) having a cutter blade and a counter anvil (1) having a groove (4,4') toward which the knife moves during cutting, the thread cutting apparatus being positioned in the path of the thread from the payout spool to the takeup package, and the knife being operative to move in a direction to sever the thread when the "off-size" signal is sensed, and which comprises the steps of passing the thread in front of the cut-off knife out of contact with the blade edge (2);

and positioning a counter surface of the counter anvil (1) for the cutter blade from the knife edge at a location which is beyond the end position of the cutter blade when responding to an "off-size" signal to permit, upon movement of the knife, an untensioned, broken thread in front of the knife to escape beyond said end position and thus escape being cut, while effecting cutting of a tensioned, unbroken thread in front of the cut-off knife.

8. Method according to claim 7, wherein the anvil includes an engagement surface (14) positioned in the direction of thread travel from the payout spool to the takeup package and located opposite the cut-off knife;

and wherein the depth of the groove (4') is deeper than the distance of movement of the cutter blade when responding to an "off-size" signal plus at least the thickness of the thread;

and further including the step of engaging the moving thread with the cutter blade and lifting the cutter blade by frictional engagement against the engagement surface if the thread is tensioned and, upon a thread break and when the cutting apparatus responds to an "off-size" signal, avoiding said lifting step, and hence preventing cutting action of the cutter blade against the counter anvil by causing the slack thread to engage within the groove (4') without cutting engagement with the thread.

9. According to claim 7, wherein the depth of the groove (4, 4') is at least as deep as the distance of movement of the cutter blade when responding to an "off-size" signal plus the thickness of the thread and has a width which is at least as wide as the thickness of the cutter blade plus twice the thickness of the thread.

* * * * *